US008016380B2

(12) United States Patent
Codos et al.

(10) Patent No.: US 8,016,380 B2
(45) Date of Patent: Sep. 13, 2011

(54) HIGH PRECISION FEED PARTICULARLY USEFUL FOR UV INK JET PRINTING ON VINYL

(75) Inventors: Richard N. Codos, Warren, NJ (US); William W. Collan, Freehold, NJ (US); Angelo Quattrociocchi, Mississauga (CA); Peter Vogel, Thole (CH)

(73) Assignee: Polytype S.A., Fribourg (CH)

( * ) Notice: Subject to any disclaimer, the term of this patent is extended or adjusted under 35 U.S.C. 154(b) by 596 days.

(21) Appl. No.: 10/597,546

(22) PCT Filed: Jan. 28, 2005

(86) PCT No.: PCT/US2005/002539

§ 371 (c)(1),
(2), (4) Date: Aug. 21, 2008

(87) PCT Pub. No.: WO2005/074519

PCT Pub. Date: Aug. 18, 2005

(65) Prior Publication Data

US 2008/0297559 A1 Dec. 4, 2008

Related U.S. Application Data

(60) Provisional application No. 60/540,933, filed on Jan. 30, 2004.

(51) Int. Cl.
*B41J 29/393* (2006.01)

(52) U.S. Cl. ..... 347/19; 347/5; 347/14

(58) Field of Classification Search ..... 347/5, 9, 347/16, 19, 14; 346/29

See application file for complete search history.

(56) References Cited

U.S. PATENT DOCUMENTS 4,485,982 A 12/1984 St. John et al.
(Continued)

FOREIGN PATENT DOCUMENTS

WO 0218148 A1 3/2002
(Continued)

OTHER PUBLICATIONS

U.S. Patent and Trademark Office, Search Report, of corresponding PCT/US05/02539, dated Jan. 15, 2006.

*Primary Examiner* — Lam S Nguyen
(74) *Attorney, Agent, or Firm* — Wood, Herron & Evans, LLP

(57) ABSTRACT

An apparatus (30, 40, 50) and a method of ink jet printing are disclosed that use a system for feeding a substrate longitudinally relative to a support area and a system for moving a printhead parallel to the direction of substrate feed. Indexing between transverse scan rows of a printhead (20) is carried out initially by the substrate feed system (16) and the actual feed distance is measured using an encoder or other substrate position measurement device (26). A controller (25) determines the amount of any error that occurs between the actual and the desired feed distances. The controller (25) then sends signals to move the printhead (20) to compensate for any error in the feed system feed. Compensating adjustments are then made to the next subsequent substrate indexing step so that the printhead tends to move back toward its home or zeroed position with its next correction and does not walk away from this home position as a result of cumulative movements. For printers that have bridges (17) moveable relative to the machine frame (11) on which the printhead (20) is carried, printhead motion is achieved by moving the bridge, for example, by actuating a linear servo bridge motion system (31). For fixed bridge roll-to-roll printers, the printhead (20) can be caused to shift longitudinally on the bridge (17) to make the correcting movements.

2 Claims, 2 Drawing Sheets

U.S. PATENT DOCUMENTS

| | | | | |
|---|---|---|---|---|
| 4,734,868 | A | 3/1988 | DeLacy | |
| 5,126,754 | A * | 6/1992 | Spinar et al. | 346/29 |
| 5,771,050 | A * | 6/1998 | Gielen | 347/19 |
| 6,012,403 | A | 1/2000 | Codos et al. | |
| 6,158,344 | A | 12/2000 | Walker et al. | |
| 6,296,403 | B1 | 10/2001 | Duchovne | |
| 6,312,123 | B1 | 11/2001 | Codos et al. | |
| 6,454,474 | B1 | 9/2002 | Lesniak et al. | |
| 6,467,898 | B2 | 10/2002 | Codos et al. | |
| 6,523,921 | B2 | 2/2003 | Codos | |
| 6,702,438 | B2 | 3/2004 | Codos et al. | |

FOREIGN PATENT DOCUMENTS

| | | | |
|---|---|---|---|
| WO | 02078958 | A1 | 10/2002 |

* cited by examiner

HIGH PRECISION FEED PARTICULARLY USEFUL FOR UV INK JET PRINTING ON VINYL

This application claims the benefit of U.S. Provisional Application Ser. No. 60/540,933, filed Jan. 30, 2004, hereby expressly incorporated herein by reference.

FIELD OF THE INVENTION

This invention relates to ink jet printing, and more particularly, to the longitudinal indexing of a printhead relative to a substrate between transverse scans of the printhead.

BACKGROUND OF THE INVENTION

The use of ink jet printing in wide format applications is expanding. In wide-format ink-jet printing, substrates, from rigid panels or flexible roll-to-roll webs, are supported relative to an ink-jet printhead. The printhead typically prints by moving transversely, relative to the substrate at a printing station where the substrate is supported, to print a row of an image on the substrate. The printhead moves across the substrate on a bridge that extends transversely across the substrate at the printing station, carrying the printhead on a carriage that is moveable on the bridge. Such a row of the image is typically formed of a plurality of lines of dots jetted from a corresponding plurality of nozzles on the printhead. A complete image is formed by printing a plurality of such rows side by side in a scanning motion by indexing the printhead longitudinally relative to the substrate. Traditionally, there has been no relative movement between the printhead and the substrate during the transverse movement of the printhead over the substrate when printing a row of the image. Between the printing of each row of the image, however, longitudinal indexing of the substrate relative to the printhead is carried out. This indexing can be achieved by moving the substrate longitudinally on its support or by moving the bridge relative to the support. A printing system that provides both types of longitudinal movement is disclosed in U.S. Pat. No. 6,012,403, hereby expressly incorporated by reference herein.

The relative movement between the printhead and the substrate in the longitudinal direction, that is, perpendicular to the transverse row-printing movement of the printhead, requires that the indexing distance be achieved with sufficient precision to avoid visible artifacts in the printed image caused by tolerances in the lengths of the indexing steps between the printing of the transverse lines of dots of adjacent rows. The degree of precision required depends, in addition to the resolution requirements of the particular application, on the nature of the ink being jetted and the physical properties of the substrate. For example, much wide format printing is for posters, banners and signs that are printed on vinyl substrate webs, either by roll-to-roll or roll-to-sheet processes. Traditionally, these substrates have been printed with solvent-based inks that form dots that spread somewhat on the vinyl substrate before drying. Such dot spread tends to forgive longitudinal feed errors of several thousandths of an inch. This dot spread, however, limits the resolution of the image being printed and the overall quality of the image.

Advantages in wide format ink jet printing have resulted from the use of inks that are cured by exposure to ultraviolet light. These UV-curable inks can produce superior images in many applications and can print on some substrates on which other inks cannot. Furthermore, UV-curable inks do not have some of the occupational and environmental disadvantages of some other inks. Examples of ink-jet printing with UV ink are described in U.S. Pat. Nos. 6,312,123; 6,467,898; 6,523,921 and 6,702,438 and in PCT publications WO02/078958 and WO02/18148, hereby expressly incorporated by reference herein.

Advantages of UV inks over solvent-based and other inks include, for example, less dot spread, particularly on substrates such as vinyl. Such property of UV inks can provide higher resolution. Higher resolution can, however, reveal artifacts such as those caused by feed or indexing tolerances between scan rows of the printhead. The human eye, for example, can detect defects of less than 1 mil (i.e., <0.001 inch). This has created problems with roll-fed substrates, particularly smooth, low-absorbency substrates, that can occur when the dot-spread is minimal.

Web fed printers are particularly prone to longitudinal feed errors that have been difficult to control. Cumulative tolerances in the drive linkages, potential slippage of the substrate on the rollers, and other mechanical limitations have produced errors that are difficult to predict when attempting to longitudinally index a web, particularly a web of highly flexible material. Attempts to improve indexing precision between the printhead and the substrate have focused on feed controls. The use of an encoder, for example, to measure the actual feed of the substrate relative to the printhead bridge, has been attempted. The use of an encoder in a closed loop control of the substrate feed drive has been only moderately successful because of a lack of control "stiffness" in the loop. The use of an encoder to read the results of an indexing step and feed the results back to the control to make a subsequent correction has presented other problems.

When error signals from encoders have been received by feed system controllers following a longitudinal feed step, time is consumed in making a post-feed correction, delaying the transverse printhead scan. Further, the correction feed step is also prone to error, which can require a still further corrective move. In addition, the error can indicate that the substrate has been fed too far, requiring a negative correction step, or a backward move of the web. Not all machines are capable of executing reverse moves of a substrate web, and many of those that can reverse the substrate feed cannot do so accurately or efficiently. As a result, deliberately under-feeding the web has been tried. Underfeeding of the web increases the likelihood that a correction is needed and increases the overall likely number of corrections that must be made. As a result of these difficulties, high quality ink-jet printing with UV ink onto smooth substrates has not been realized in most applications where the above problems are presented.

Accordingly, there is a need for a way to increase precision in the relative longitudinal feeding between printheads and substrates, particularly smooth substrates such as vinyl, and particularly when printing with UV inks.

SUMMARY OF THE INVENTION

A primary objective of the present invention is to provide for increased precision in the imparting of relative movement of a substrate relative to the transverse path of an ink-jet printhead.

According to the principles of the present invention, a compound feed system imparts relative movement of a substrate relative to the transverse path of an ink-jet printhead.

These and other objectives and advantages of the present invention will be more readily apparent from the following detailed description.

DETAILED DESCRIPTION

Figure 1:
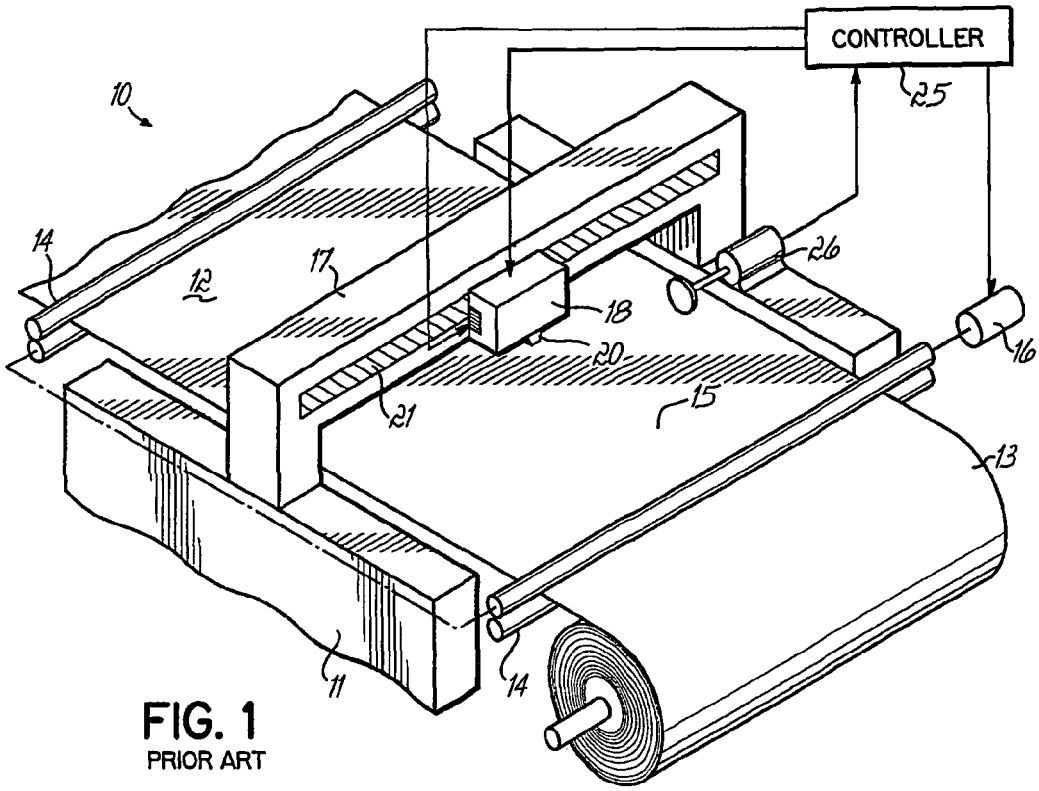
FIG. 1 PRIOR ART
FIG. 1 is a perspective diagram of an ink-jet printing system of the prior art.

In FIG. 1, an ink-jet printing apparatus 10 of the prior art is illustrated. The apparatus 10 includes a frame 11 having a substrate support plane 12 over which a substrate 15 is supported. The substrate 15 is illustrated as a web of material that is longitudinally fed from a roll supply 13 thereof, along the frame 11 and over the support plane 12, by one or more sets of feed rolls 14 that are mounted to rotate on the frame 11. A drive motor 16, which may be a servo drive motor, advances the substrate 15 past a bridge 17, which is fixed to the frame 11, and on which bridge is mounted a carriage 18 to move on the bridge 17 in a direction transverse to that of the feed. The carriage 18 has mounted thereon one or more ink-jet printheads 20, which it carries with it transversely across the frame 11. The carriage 18 is moved across the bridge 17 by a linear servo motor 19 carried by the bridge 17 and the carriage 18. The printheads 20 include nozzles (not shown), which are directed from the carriage 18 toward the support plane 12 so as to jet ink onto a substrate 15 when supported in the plane 12. A controller 25 operates the printheads to synchronize the jetting of the ink onto the substrate with the position of the printheads relative to the substrate in order to produce an image in accordance with a programmed pattern. The controller 25 also controls the motor 16 that moves the substrate 15 longitudinally relative to the frame 11 and the motor 21 that moves the carriage 18 transversely across the bridge 17.

The apparatus 10 is also provided with an encoder 26, which is mounted on the frame 11 at a point near the stationary bridge 17 and has a sensor wheel 27, approximately 6 inches in diameter, that engages the substrate 15 and produces a measurement signal in response to the movement of the substrate 15 relative to the bridge 17. This measurement signal is sent to the controller 25, which in response to the substrate feed measurement signal, sends a feed adjustment signal to the motor 16. The motor 16 makes a feed adjustment to the substrate 15. In the prior art, such adjustment has not been totally satisfactory in eliminating feed error artifacts.

Figure 2:
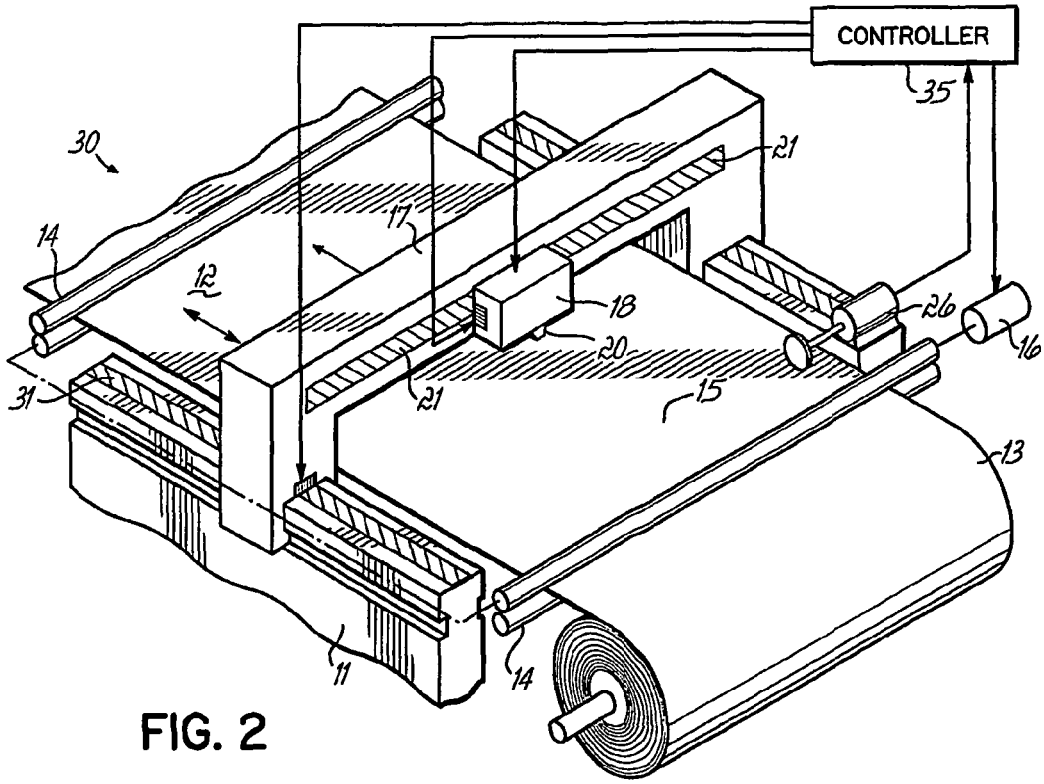
FIG. 2 is a perspective diagram, similar to FIG. 1, illustrating an embodiment of an ink-jet printing system embodying principles of the present invention.

In FIG. 2, a printing apparatus 30 according to an embodiment of the present invention is illustrated. The apparatus 30 has certain elements that are the same as the elements of the apparatus 10 of FIG. 1, which elements are similarly numbered. In addition, the apparatus 30 includes a feed system having the features of that in U.S. Pat. No. 6,012,403, where the bridge 17 is mounted to move longitudinally on the frame 11. This movement is provided by linear servo motors 31 carried by the bridge 17 and the frame 11. A controller 35 is provided having the functions described for the controller 25 of the apparatus 10 above, with additional functions including the ability to control the motors 31 to move the bridge 17 relative to the frame 11 in a longitudinal direction. As such, the controller 35 can index the substrate 15 longitudinally relative to the printhead 20 by holding the bridge 17 stationary relative to the frame 11 and moving the substrate 15 longitudinally relative to the frame 11, or by holding the substrate 15 stationary relative to the frame 11 and moving the bridge 17 relative to the frame 11, or by a combination of the motions of the bridge 17 and the substrate 15 relative to the frame 11. Accordingly, the motors 16 and 31 can be energized alternatively or in combination by the controller 35.

Experience has shown that longitudinal indexing of the printhead 20 relative to the substrate 15 that is made with movement of the bridge 17 on the frame 11 by the motor 31 can be far more accurate than indexing made with movement of the substrate 15 relative to the frame 11 by the motor 16. However, there are applications where feeding the substrate 15 over the frame 11 by activation of the motor 16 has advantages, particularly where large images are printed on a continuous substrate web.

According to the present invention, an encoder 26 or other position measurement and feedback device is configured and mounted on the apparatus 30 in such a manner as to accurately measure the actual distance that the web 15 is fed in response to the actuation of the motor 16 in response to an indexing command signal from the controller 25. In the embodiment of FIG. 2, the position measurement device is in the form of an encoder or resolver 26 and is mounted at a fixed point on the frame 11 near the normal resting place of the bridge 17 in apparatus 30. The encoder 26 is trued or is otherwise sufficiently precise to measure the actual fed distance with an accuracy that corresponds to the desired indexing precision desired. For example, if indexing precision of $\frac{1}{2000}$th of an inch is desired to avoid printing artifacts, the position measurement device should be configured to read the actual fed distance to at least $\frac{1}{2000}$th of an inch, and preferably $\frac{1}{4000}$th of an inch.

The controller 35 is programmed so that, when the substrate 15 is fed by activation of the motor 16, the motion of the substrate 15 is measured by the encoder 26, the controller 35 receives the measurement signal from the encoder 26, calculates any feed error, and sends a correction signal to the motor 31. In this way the motor 31 moves the bridge 17 to move the printhead 20 a longitudinal distance that compensates for any error in the feed of the substrate 15 by the motor 16. Such movement of the bridge 17 by the motor 31 can be carried out with accuracy, typically of the order of +/−5 microns. As a result, feed correction can be precisely and quickly made during the time that the printhead carriage is reversing direction off to the side of the substrate 15 between printhead scans that result in the printing of rows of the image on the substrate 15.

Further according to the present invention, any error correction made by movement of the bridge 17 by the motor 31 is subtracted from the next indexing motion signaled by the controller 35 to the motor 16. For example, if a correction X is made by moving the bridge 17 that amounts in the forward longitudinal direction, the next feed distance of the substrate 15 is reduced by the amount X. If the correction had been made in the reverse longitudinal direction, then X is added to the next feed distance of the substrate 15. This keeps the bridge 17 from progressively moving longitudinally along the frame 11 and eventually reaching the end of its travel.

Figure 3:
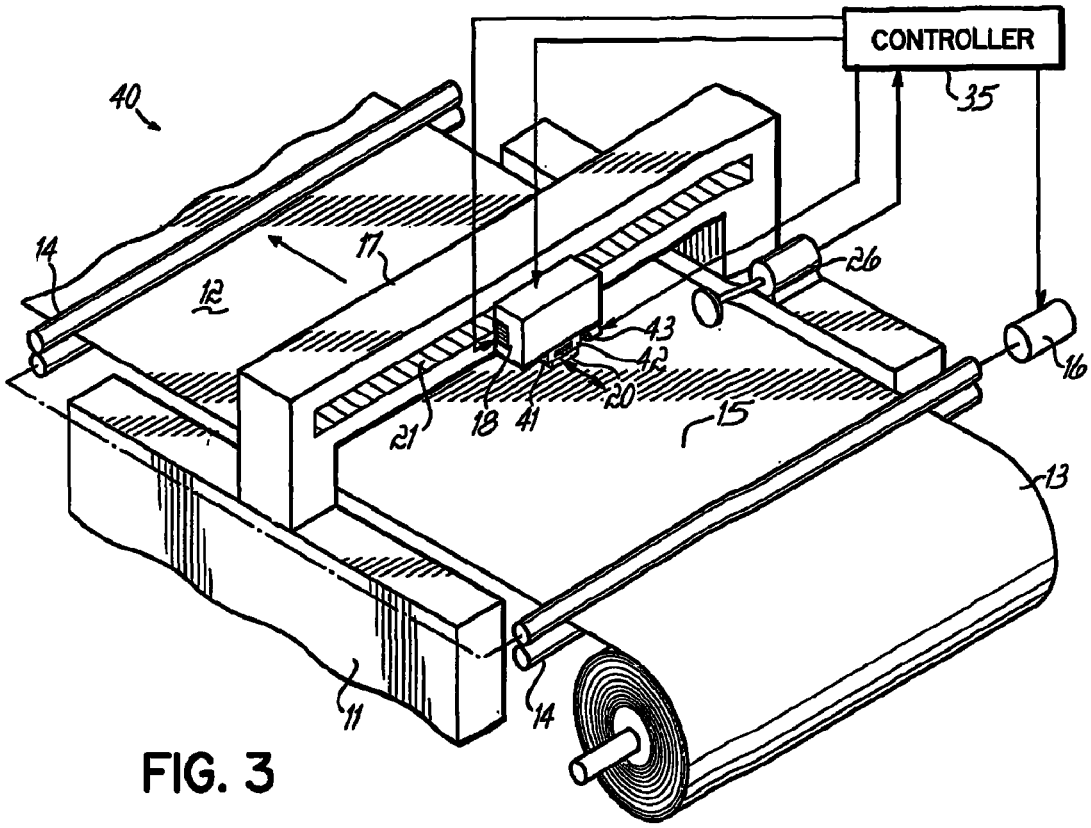
FIG. 3 is a perspective diagram, similar to FIG. 2, illustrating an alternative embodiment of an ink-jet printing system embodying principles of the present invention.

FIG. 3 illustrates an ink-jet printing apparatus 40 according to another embodiment of the invention, in which the bridge 17 is stationary on the frame 11. In the apparatus 40, the printhead 20 is provided with a small amount of movement capability in the longitudinal direction on the carriage 18. This movement capability need be only a few thousandths of an inch. It can be implemented by providing a slidable mount 41 for the printhead 20 on the carriage 18 that provides a small amount of longitudinal printhead travel. A cam 42 may be provided for moving the printhead on this mount that is driven by a servo motor 43. In operation, the controller 35 sends the correction signal to the servo motor 43 in the same manner that it was sent to the servo 31 in the embodiment 30 above. This embodiment can be easily adapted to existing web-fed printing machines having fixed bridges.

Figure 4:
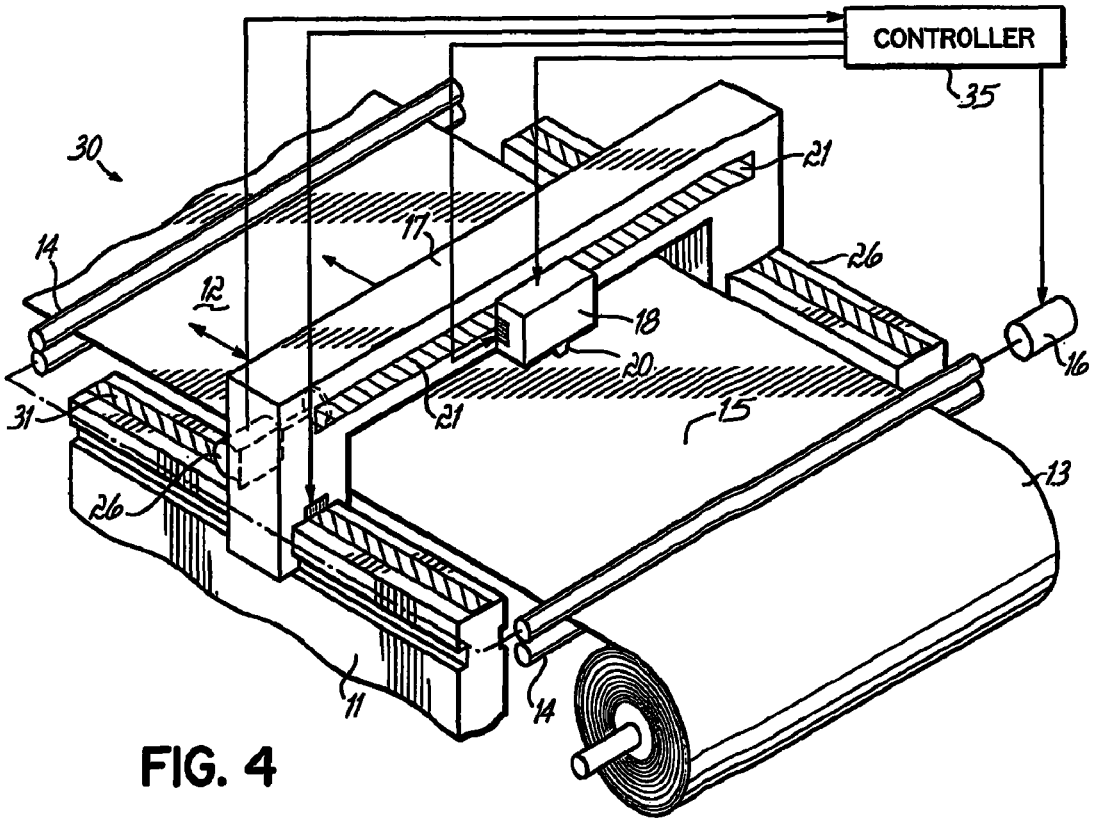
FIG. 4 is a perspective diagram, similar to FIG. 2, illustrating another alternative embodiment of an ink-jet printing system embodying principles of the present invention.

FIG. 4 illustrates an ink-jet printing apparatus 50 according to another embodiment of the invention, in an encoder or resolver 26 is fixed to the bridge 17 to move with the bridge 17 rather than be stationary relative to the frame 11. This placement of the position measurement device is more likely to accurately measure the actual movement of the web 15 past the printhead regardless of the position of the bridge 17. In the apparatus 50, the output of the position measuring device is the actual distance moved by the web relative to the last position of the printhead 20.

While in the illustrations the position measurement and feedback device is shown diagrammatically as an encoder or resolver, those skilled in the art will appreciate that other devices that will accurately measure the distance moved by the web 12 can be used.

The invention has been described in the context of exemplary embodiments. Those skilled in the art will appreciate that additions, deletions and modifications to the features described herein may be made without departing from the principles of the present invention. Accordingly, the following is claimed:

The invention claimed is:

1. An ink jet printing apparatus comprising:

a frame;

a bridge extending transversely across the frame and defining a position of a printing station relative to the frame;

a feed system configured to advance a substrate longitudinally relative to the frame through the printing station;

a printhead moveable transversely across the bridge to print a row of an image across the substrate at the printing station;

a motion system connected to the bridge and configured to move the printhead longitudinally relative to the frame;

a controller operable to activate the feed system to index the substrate longitudinally a predetermined distance through the printing station;

a web position measurement device mounted to the bridge and operable to measure, and communicate to the controller a signal corresponding to, an actual distance moved by the substrate through the printing station during the indexing of the substrate;

the controller being operable to activate the motion system, in response to the signal to move the printhead longitudinally, relative to the indexed substrate, a correction distance corresponding to the predetermined distance less the actual distance moved by the substrate during the indexing of the substrate;

the bridge having a carrier transversely moveable thereon;

the printhead being longitudinally moveable relative to the carrier;

the carrier having a motor mounted thereon and connected to the printhead, the motor being operable to move the printhead relative to the carrier along the longitudinal direction of the substrate in response to the activation of the motion system to adjust the longitudinal position thereof relative to the substrate at the printing station; and the controller being operable to activate the motion system to operate the motor to move the printhead longitudinally relative to the bridge to thereby move the printhead longitudinally the correction distance relative to the substrate.

2. The apparatus of claim 1 wherein:

the web position measurement device includes an encoder responsive to the motion of the substrate relative thereto and operable to generate the signal corresponding to an actual distance moved by the substrate through the printing station during the indexing of the substrate.

* * * * *